United States Patent [19]

Smith et al.

[11] Patent Number: 4,944,863

[45] Date of Patent: Jul. 31, 1990

[54] THERMAL HYDROCRACKING OF HEAVY STOCKS IN THE PRESENCE OF SOLVENTS

[75] Inventors: C. Morris Smith, Princeton, N.J.; Dennis E. Walsh, Richboro, Pa.

[73] Assignee: Mobil Oil Corp., New York, N.Y.

[21] Appl. No.: 409,374

[22] Filed: Sep. 19, 1989

[51] Int. Cl.[5] ..... C10G 47/00

[52] U.S. Cl. ..... 208/107; 208/48 AA; 208/48 R; 208/143; 208/46; 208/106; 208/142

[58] Field of Search ..... 208/48 AA, 48 R, 107, 208/143

[56] References Cited

U.S. PATENT DOCUMENTS

| | | | |
|---|---|---|---|
| 2,917,532 | 12/1959 | Watkins | 208/107 |
| 4,002,556 | 1/1977 | Satchell, Jr. | 208/107 |
| 4,363,716 | 12/1982 | Greene et al. | 208/107 |
| 4,389,303 | 6/1983 | Simo | 208/107 |
| 4,395,324 | 7/1983 | Derbyshire | 208/107 |
| 4,434,045 | 2/1984 | Vernon et al. | 208/107 |
| 4,485,004 | 11/1984 | Fisher et al. | 208/107 |
| 4,640,762 | 2/1987 | Woods et al. | 208/107 |
| 4,698,147 | 10/1987 | McConaghy, Jr. | 208/107 |

FOREIGN PATENT DOCUMENTS

| | | | |
|---|---|---|---|
| 1785 | 1/1983 | Japan | 208/107 |

OTHER PUBLICATIONS

Ind. Eng. Chem. Process Des. Dev. (1983), 22, 242–248 Sachio Asaoka, et al. "Asphaltene Cracking in Catalytic Hydrotreating of Heavy Oils".

Hydrocarbon Processing (May 1980) pp. 101–109, Frank Stolfa "New Roles for Thermal Cracking".

Hydrocarbon Processing (Feb. 84) pp. 75–82 B. Schuetze & H. Hofmann "How to Upgrade Heavy Feeds".

Ind. Eng. Chem. Process Des. Dev. (1986), 25, 1–12 Bala Subramaniam and Mark A. McHugh "Reactions in Supercritical Fluids—A Review".

*Primary Examiner*—Helane Myers

*Attorney, Agent, or Firm*—Alexander J. McKillop; Charles J. Speciale; Dennis P. Santini

[57] ABSTRACT

This invention relates to a process in which the addition of a substantially inert solvent to a heavy petroleum stock permits high conversion hydrocracking and hydrogen addition to be accomplished in the absence of catalyst or additive.

23 Claims, 2 Drawing Sheets

ARBITRARY SHUTDOWN
FORCED SHUTDOWN
ARBITRARY SHUTDOWN
● 100% VR @ 1 LHSV
■ 1MN/VR @ 1 LHSV
▲ 1MN/VR @ 0.4 LHSV
VOLUME OF 1000F+ CONVERTED (mls)
TIME ON STREAM (HRS)
0
250
500
750
1000
1250
1500
0
50
100
150
200
250
300

● 100% VR @ 1 LHSV
■ 1MN/VR @ 1 LHSV
▲ 1MN/VR @ 0.4 LHSV
HYDROGEN CONSUMED (%)
1000F+ CONVERSION (%)
0
0.2
0.4
0.6
0.8
1.0
1.2
30
40
50
60
70

THERMAL HYDROCRACKING OF HEAVY STOCKS IN THE PRESENCE OF SOLVENTS

FIELD OF THE INVENTION

This invention relates to thermal treatment of heavy stocks. The treatment occurs with hydrogen addition in the presence of solvents preferably at dense-super-critical or super-critical conditions.

The present invention involves the use of solvent and hydrogen to facilitate thermal hydrocracking of resids and heavy stocks. By thermal, applicants mean cracking in the absence of a catalyst or additive. By hydrocracking, applicants mean greater than about 40% 1000° F.+ conversion.

BACKGROUND OF THE INVENTION

Conversion of heavy stocks into distillates requires substantial boiling range reduction via thermal, catalytic, or hydrocatalytic cracking. One of the major difficulties in such conversion processes is that these heavy petroleum fractions are hydrogen deficient compared to the distillates into which they are to be converted. Their upgrading, particularly catalytic upgrading, is further complicated by substantial levels of heteroatoms (S+N), metals (Ni+V) and asphaltenes. Contaminant levels must be reduced and hydrogen content enriched by processes in which carbon is rejected or hydrogen is added.

Carbon rejection processes necessarily limit liquid yield due to the constraints of stoichiometry. Furthermore, at high temperatures typical of thermal processing, thermodynamic equilibrium favors the formation of coke and high H-content gas. However, thermal carbon rejection processes are well known in the prior art. For example, coking easily converts 100% of a wide range of feedstocks, but is limited to relatively low coker gas oil yield. The products are unstable and require subsequent hydrotreating. Although coking is a flexible process, the quality and marketability of the coke and the degree of treatment required to upgrade the coker gas oil are dependent on feedstock quality. Another thermal process, visbreaking is a low conversion process mostly used to reduce feed viscosity and minimize heavy fuel oil production. Typical conversions are restricted to less than 40% to avoid significant coke formation.

Fluid catalytic cracking is a carbon rejection process which uses a catalyst to maximize gasoline and gas oil quality and yield. However, the most advanced resid crackers are limited to feedstocks with less than about 10% Conradson carbon (CCR) and 60 ppm Ni+V. These specifications exclude almost all heavy stocks, and include only a limited number of higher quality or treated atmospheric resids. Due to stoichiometric limitations, gasoline and distillate yield is less than obtained in catalytic hydrocracking, but is greater than that in coking due to the action of the catalyst.

A number of commercial and exploratory processes for hydrotreating or hydrocracking heavy stocks are known. These are catalytic processes in which hydrogen is added, but feed metals can poison the catalyst and shorten its life. Pressure drop may increase unacceptably in fixed bed processing from accumulation of particulate matter plus coke formed during reaction of the heavy stock, especially at high temperatures. These considerations result in poor cycle length and catalyst life. Moving bed configurations can avoid bed plugging; but fresh catalyst make-up rates, needed to maintain a constant activity level, depend on feedstock quality and are often unacceptably high. Furthermore, these catalytic processes can lead to unselectively high hydrogen consumption, resulting in, for example, hydrogenation of the high-octane aromatic components of gasoline.

Hydrocracking processes such as CANMET and Veba Combicracking can obtain high resid conversions using a relatively wide range of feedstock qualities. Although these processes do not employ a fixed or moving bed of "conventional" catalyst, they do use additives which impart catalytic functionality. Conversion may occur substantially by a thermal mechanism, assisted by the "additive" which may catalytically stabilize the products, preventing their further degradation to coke and gas.

The present invention is a thermal process which uses a solvent to facilitate the addition of hydrogen to the heavy stock while suppressing coke and gas make. The ability of the present invention to add hydrogen in the absence of a catalyst or catalytic "additives" eliminates catalyst fouling and makeup rate problems which are inherent in typical catalytic processes. The current invention permits conversions in excess of 40%, typically 60–80%, with hydrogen addition of up to about 700 SCFB (heavy stock basis), and coke selectivities below about 1 wt %. This allows extended continuous operation with a wide range of feedstocks.

SUMMARY OF THE INVENTION

This invention relates to a process for treating heavy petroleum stocks comprising thermally hydrocracking a heavy stock in the presence of gaseous hydrogen and a substantially inert solvent.

This invention also relates to a process for treating vacuum resids or heavy stocks comprising thermally hydrocracking vacuum resids or heavy stocks in the presence of a substantially inert solvent under conditions such that the solvent is substantially in its super-critical or dense super-critical state and in the presence of gaseous hydrogen.

BRIEF DESCRIPTION OF THE DRAWINGS

The invention will now be described regarding drawings which are not considered to limit the invention.

DETAILED DESCRIPTION OF THE INVENTION

Figure 1:
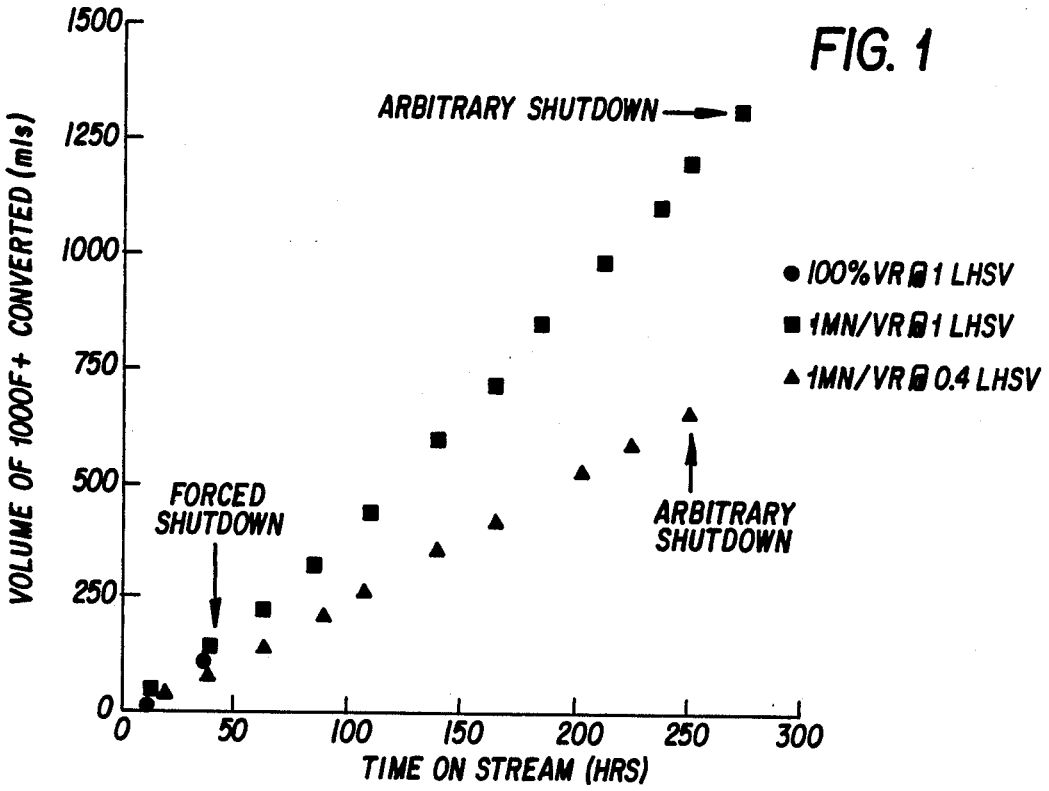
FIG. 1 compares operability in the presence of 1-methylnaphthalene showing total volume of converted product verses time on stream.

This invention embodies a thermal process in which the addition of solvent permits heavy stock hydrocracking at greater than about 40%, preferably greater than about 50% 1000° F.+ conversion with hydrogen addition accomplished in the absence of a catalyst or additive. It is believed that the solvent helps reduce physical barriers to direct addition of gas phase hydrogen to free radicals formed in thermal cracking. In a preferred embodiment, the solvent is in its super-critical or dense super-critical phase regime. Dense super-critical means that at the operating condition of the invention the pure solvent would be above its critical pressure but below its critical temperature, while super-critical would mean that the solvent is above both its critical pressure and its critical temperature.

Heavy stocks, as defined in this invention, include whole crudes and distillation residues thereof having one or more of the following characteristics: (1) API gravity less than about 20°; (2) hydrogen content below about 11 wt %; (3) metals concentration greater than about 100 ppm; and (4) heteroatom content greater than about 3 wt %. Increased upgrading of such heavy stock is expected in the future.

The operating conditions for this new process are presented in the following table:

TABLE 1

| Operating Ranges | General | Preferred |
|---|---|---|
| Temperature (°F.) | 700–950 | 770–870 |
| Pressure (psig) | 500–3,000 | 1,000–2,000 |
| LHSV ($hr^{-1}$) | 0.1–5 | 0.5–3 |
| Solvent (wt % of feed mixture) | 10–90 | 15–40 |
| $H_2$ Circulation (SCFB) | 500–10,000 | 2,500–5,000 |

Examples of solvents useful in the present invention include paraffins and olefins such as dodecane, hexadecane, hexadecene, etc., cycloparaffins such as cyclohexane and decalin, aromatics such as benzene and naphthalene, etc., and alkylaromatics such as toluene, xylenes, propylbenzene, methylnaphthalene, etc. Preferably, the solvent is in its super-critical or dense super-critical state at the operating conditions specified in Table 1, (for example, hexadecane, methylnaphthalene and toluene).

The solvents are those which are not hydrogen donors, i.e., they as substantially inert under applicants' reaction conditions are specified in Table 1.

The prior art indicates that high vacuum resid conversions (>about 50%) cannot be achieved in the presence of an inert solvent alone or the use of $H_2$ alone without substantial coke make. Applicants have discovered that through the combined use of an inert solvent and $H_2$, that elevated conversions (up to about 75% 1000° F. +) can be sustained with less than 1% coke selectivity.

EXAMPLES

The invention will now be explained using non-limiting examples.

EXAMPLE 1

According to the present invention, 1-methylnaphthalene, was combined with Arab Light vacuum resid in a 1:2 weight ratio and fed at 15 cc/hr over 10 cc of an inert vycor packing with 150 SCCM $H_2$, at 1900 psig total pressure and 870° F. Vacuum resid conversion of about 65% to 75% was sustained for greater than 10 days of operation at which time the run was arbitrarily terminated. At these conditions, 1-methylnaphthalene was above it critical pressure and below its critical temperature. This demonstrated sustained operability for vacuum resid conversions >50% in the presence of solvent and $H_2$.

EXAMPLE 2

When Arab Light vacuum resid was processed as in Example 1, but without solvent, vacuum resid conversion was limited to about 35% during the first 2 days. Increasing severity to achieve higher conversion led to unit plugging due to coke deposition and forced shutdown with 2 hours. Thus, FIG. 1 shows reduced operability in the absence of solvent. Forced shutdown occurred in this example compared to arbitrary shutdown at >65% conversion after 10 days in Example 1.

EXAMPLE 3

When Arab Light vacuum resid was processed, as in Example 1, but $H_2$ was replaced with $N_2$, vacuum resid conversion was limited to about 45%. Increasing severity did not increase conversion; forced shutdown due to excessive pressure drop occurred within 3 days of attempting the more severe condition. This example showed reduced operability in the absence of $H_2$, but in the presence of solvent compared to Example 1. Forced shutdown occurred within 5 days at 45% conversion in this example compared to arbitrary shutdown at >65% conversion after 10 days in Example 1.

EXAMPLE 4

Since high conversion of Arab Light vacuum resid could not be achieved in fixed bed operation without solvent as described in Example 2, thermal conversion was carried out in a stirred autoclave with $H_2$ at 2000 psig and no solvent. In this mode, 67% vacuum resid conversion was achieved in the absence of solvent with corresponding coke selectivity of about 11%. Thus, coke selectivity in the absence of solvent, but in the presence of $H_2$ is about 11% while coke selectivity according to the present invention is less than 0.7% at comparable conversion.

EXAMPLE 5

As in Example 1, but following a 10 day time-temperature protocol at 1 LHSV, maximum conversion was 57%. Initial conversion at 840° F. was about 49%, and dropped to 39% after the 10-day test. Reduced conversion with time on stream was due to coke deposition in the bed of inert packing, increasing effective LHSV. Toluene, being above both its critical pressure and temperature under reaction conditions, was substituted for 1-methylnaphthalene in the same 10-day test. Performance was generally similar with toluene reaching the same maximum conversion with about the same percentage loss of conversion over the course of the 10-day test.

EXAMPLE 6

Figure 2:
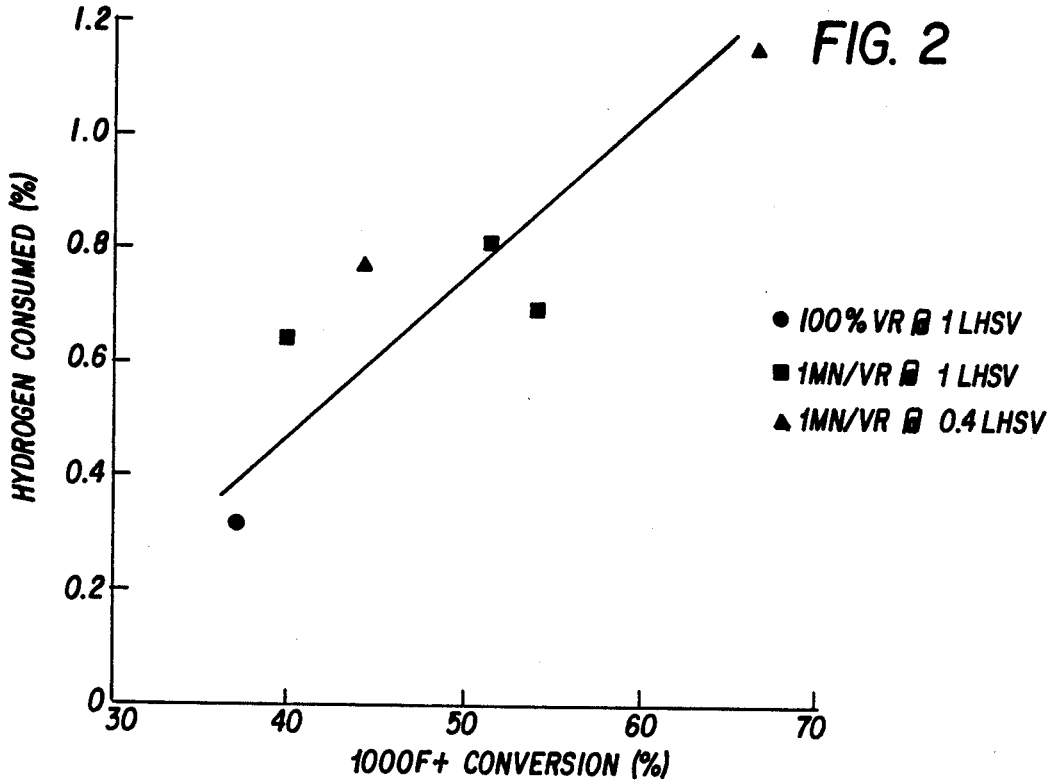
FIG. 2 shows hydrogen consumption verses conversion with and without solvent present.

In Example 4, no net gas phase $H_2$ consumption was observed for thermal conversion of Arab Light vacuum resid. Likewise, in Example 2, processing over an inert vycor packing, but in the absence of solvent, insignificant $H_2$ consumption, <0.3 wt % (<180 SCFB) was observed. FIG. 2 shows that in the present invention, gas phase $H_2$ consumption was observed, increasing from about 0.6 wt % to 1.2 wt % (=720 SCFB) with increasing vacuum resid conversion.

EXAMPLE 7

Figure 3:
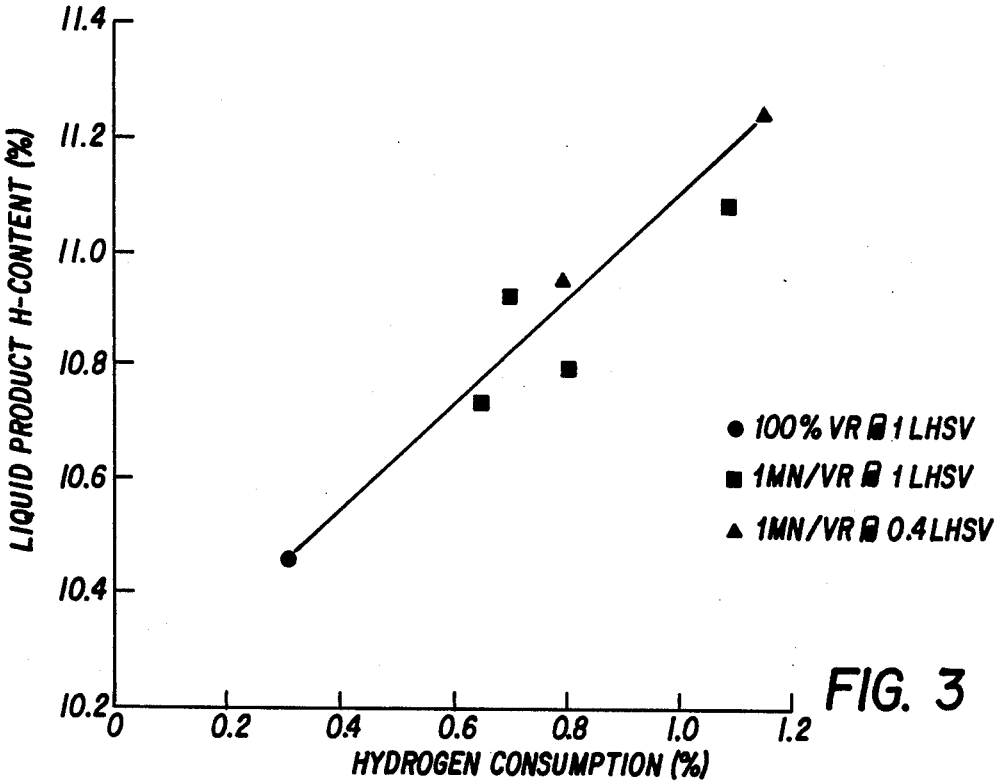
FIG. 3 shows that hydrogen consumed from the gas phase is used to greatly improve the H-content of liquid product formed from heavy stock conversion. Liquid product H-content is calculated after debiting for the H-content of the solvent.

As in the present invention, according to Example 1, observed gas phase $H_2$ consumption was largely incorporated into the liquid product. Liquid product refers specifically to that formed from conversion of the feed heavy stock, exclusive of any added solvent. FIG. 3 shows that for every 1 wt % (=600 SCFB) $H_2$ consumed, liquid product H-content increased 0.83 wt %.

EXAMPLE 8

According to the present invention and as in Example 1, except that toluene was substituted for 1-methylnaphthalene, solvent recovery from the product was greater than 97%. Even at relatively severe reaction conditions of 1 LHSV and 870° F., solvent conversion was $<<0.1$ wt %. Thus, the solvent was substantially inert and did not participate directly in reactions with resid components.

EXAMPLE 9

According to the present invention and as in Example 1, 1-methylnaphthalene conversion was $<1.0$ wt %. Thus, the solvent was substantially inert.

EXAMPLE 10

In the present invention according to Example 1, gas make was modest, changing little with conversion. With increasing conversion and hydrogen consumption (Example 7), selectivity to liquid products in the gasoline and gas oil range ($C_5$/650° F.) increased as shown in the following Table:

TABLE 2

| Temperature | 870° F. | 870° F. |
|---|---|---|
| LHSV | 1.0 | 0.4 |
| 1000° F.+ Conversion, % | 51 | 74 |
| Selectivity, % | | |
| $C_4^-$ gases | 6.0 | 5.1 |
| $C_5$/650° F. | 51.1 | 63.4 |
| 650/1000° F. | 41.2 | 29.1 |

Thus, selectivities are favorable with increasing conversion in the present invention.

EXAMPLE 11

Figure 4:
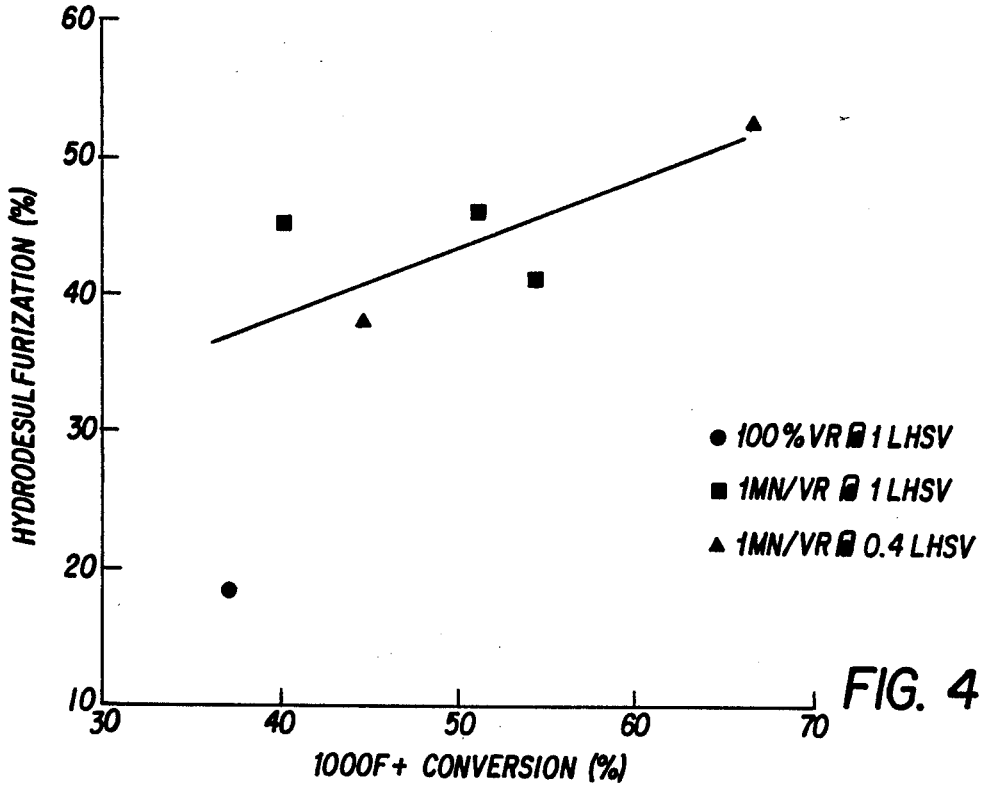
FIG. 4 shows an increasing level of hydrodesulfurization in the solvent containing experiments as conversion increased.

According to the present invention and Example 1, hydrodesulfurization (HDS) increased from about 37% to 53% with increasing boiling-range conversion as shown in FIG. 4. HDS is lower (about 20%) when the reaction was carried out in the absence of solvent according to Example 2. Thus, HDS was enhanced by the presence of solvent.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the intended spirit and scope of the appended claims.

We claim:

1. A process for treating heavy petroleum stocks comprising thermally hydrocracking a heavy stock in the presence of gaseous hydrogen and a substantially inert solvent.

2. The process according claim 1, wherein greater than ~40% conversion of the vacuum reside portion of the heavy stock is achieved.

3. The process according to claim 1, wherein coke formation is reduced verses operation without the solvent.

4. The process according to claim 1, wherein hydrogen addition to the heavy stock is increased verses operation without the solvent.

5. The process according to claim 1, wherein thermal hydrocracking occurs at greater than the critical temperature and critical pressure for the solvent.

6. The process according to claim 1, wherein thermal hydrocracking occurs at greater than the critical pressure but less than the critical temperature of the solvent.

7. The process according to claim 1, wherein the solvent is 1-methylnaphthalene or toluene.

8. The process according to claim 2, wherein the vacuum resid conversion is greater than about 50%.

9. The process according to claim 1, wherein the thermal hydrocracking occurs at a temperature between about 700° F. and 950° F.

10. The process according to claim 9, wherein the thermal hydrocracking occurs at a temperature between about 770° F. and 870° F.

11. The process according to claim 1, wherein the thermal hydrocracking occurs at a pressure between about 500 and 3,000 psig.

12. The process according to claim 11, wherein the thermal hydrocracking occurs at a pressure between about 1,000 and 2,000 psig.

13. The process according to claim 1, wherein the thermal hydrocracking occurs at a LHSV between about 0.1 and 5 $hr^{-1}$.

14. The process according to claim 13, wherein the thermal hydrocracking occurs at a LHSV between about 0.5 and 3 $hr^{-1}$.

15. The process according to claim 1, wherein the thermal hydrocracking occurs wherein feed mixture contains between about 10 and 90 wt % of solvent.

16. The process according to claim 15, wherein the thermal hydrocracking occurs with the feed mixture containing between about 15 and 40 wt % solvent.

17. The process according to claim 1, wherein the thermal hydrocracking occurs with gaseous hydrogen circulation between about 500 and 10,000 SCFB.

18. The process according to claim 17, wherein the thermal hydrocracking occurs with gaseous hydrogen circulation between about 2,500 and 5,000 SCFB.

19. A process for treating vacuum resids or heavy stocks comprising thermally hydrocracking vacuum resids or heavy stocks in the presence of a substantially inert solvent under conditions such that the solvent is substantially in its supercritical state and in the presence of gaseous hydrogen.

20. The process according to claim 19, wherein greater than ~40% conversion of the vacuum resid portion of the heavy stock is achieved.

21. The process according to claim 19, wherein coke formation is reduced verses operation without the solvent.

22. The process according to claim 19, wherein hydrogen addition to the heavy stock is increased verses operation without the solvent.

23. The process according to claim 1, wherein the substantially inert solvent is selected from dodecane, hexadecane, hexadecene, cyclohexane, decalin, benzene, naphthalene, toluene, xylenes, propylbenzene or methylnaphthalene.

* * * * *